US009072374B2

(12) United States Patent
Dange et al.

(10) Patent No.: US 9,072,374 B2
(45) Date of Patent: Jul. 7, 2015

(54) PARTITION SEPARATING COOKTOP FROM UNDERLYING COMPARTMENT

(71) Applicant: Whirlpool Corporation, Benton Harbor, MI (US)

(72) Inventors: Rohit Arun Dange, Pune (IN); Donato Lo Presti, Induno Olona (IT)

(73) Assignee: Whirlpool Corporation, Benton Harbor, MI (US)

( * ) Notice: Subject to any disclaimer, the term of this patent is extended or adjusted under 35 U.S.C. 154(b) by 42 days.

(21) Appl. No.: 13/723,246

(22) Filed: Dec. 21, 2012

(65) Prior Publication Data

US 2013/0162129 A1 Jun. 27, 2013

(30) Foreign Application Priority Data

Dec. 23, 2011 (IT) ..... MI2011A002378

(51) Int. Cl.
*A47B 77/08* (2006.01)
*F24C 15/34* (2006.01)

(52) U.S. Cl.
CPC ..... *A47B 77/08* (2013.01); *F24C 15/34* (2013.01)

(58) Field of Classification Search
CPC ..... A47B 45/00; A47B 81/062; A47B 77/08; F24C 15/34
USPC ..... 312/351, 257.1, 205, 321, 237; 126/25 R, 29, 37 R
See application file for complete search history.

(56) References Cited

U.S. PATENT DOCUMENTS

| | | | | | |
|---|---|---|---|---|---|
| 1,069,411 | A * | 8/1913 | Greene | 312/101 |
| 2,266,274 | A * | 12/1941 | Schroeder | 108/30 |
| 2,349,541 | A * | 5/1944 | Earle | 126/299 R |
| 2,393,879 | A * | 1/1946 | Barnsteiner | 126/39 BA |
| 4,155,312 | A * | 5/1979 | Thorkildson | 108/137 |
| 4,193,650 | A * | 3/1980 | Gray et al. | 312/205 |
| 4,540,222 | A * | 9/1985 | Burrell | 312/257.1 |
| 5,795,041 | A * | 8/1998 | Weaver | 312/205 |
| 6,079,400 | A * | 6/2000 | Tomat Dany | 126/37 B |
| 6,283,563 | B1 * | 9/2001 | Lambright et al. | 312/205 |
| 6,293,272 | B1 * | 9/2001 | Harneit | 126/37 B |
| 6,349,715 | B1 * | 2/2002 | McBroom | 126/276 |
| 6,877,826 | B2 * | 4/2005 | Wood et al. | 312/205 |
| 7,040,724 | B2 * | 5/2006 | Kelley et al. | 312/205 |
| 7,441,846 | B2 * | 10/2008 | Lupo | 312/205 |
| 2008/0308515 | A1 * | 12/2008 | Lange et al. | 211/134 |
| 2008/0315734 | A1 * | 12/2008 | Birsel et al. | 312/223.3 |

* cited by examiner

*Primary Examiner* — James O Hansen

(57) ABSTRACT

A partition is adapted for separating a cooktop placed on a cabinet, from an inner compartment of said cabinet, said compartment being delimited by side walls, a bottom and by a rear wall. The compartment being independently opened and upwardly presenting the cooktop and adapted to contain objects placed in a drawer or shelves fixed to the side walls. The partition which comprises at least two portions, movable relative to each other in a direction orthogonal to the side walls of the cabinet adapted to be fixed to said walls, said portions being relatively coupled in a position which is according to the distance of said side walls and such as to completely divide the cooktop from the below compartment of the cabinet.

15 Claims, 3 Drawing Sheets

PARTITION SEPARATING COOKTOP FROM UNDERLYING COMPARTMENT

TECHNICAL FIELD

The object of the present disclosure is a partition adapted to separate a cooktop from an underlying drawer, according to the preamble of the main claim.

BACKGROUND

As known, cooktops are usually placed in the upper part of a cabinet. Precisely because of their function, said tops generate heat that is transferred also into the underlying part and then inside the above mentioned cabinet.

It is known to arrange a partition below a cooktop, placed therefore between said top and the underside of the cabinet. Said known partition is fixed to the side walls of the cabinet so as to create below said top an area wherein the heat generated by the top itself cannot penetrate.

Said known partition, however, has fixed sizes and therefore cannot be used in a generalized way for different sizes of cabinets. In other words, cabinets of different sizes that have associated cooktops of corresponding different sizes (40, 60, 75 cm) must provide partitions of different sizes. This results in a greater cost to the cabinet manufacturer as well as the need of having in stock partitions usable for the different dimensions of sold cabinets.

SUMMARY

The purpose of the present disclosure is to provide a partition to be used below a cooktop and adapted to allow the positioning of objects on shelves or within a drawer arranged in a position below said cooktop, which is universally usable with different sized cabinets and on cooktops of different sizes.

Another object is to provide an universally usable partition that allows the cabinet manufacturer to reduce the costs of their products and the amount of partitions stocked in warehouse.

BRIEF DESCRIPTION OF THE DRAWINGS

These and other objects which will be apparent to those skilled in the art are attained by a partition in accordance with the accompanying claims.

For a better understanding of the present disclosure the following purely indicative, but not limitative drawings are attached, wherein.

DETAILED DESCRIPTION

Figure 1:
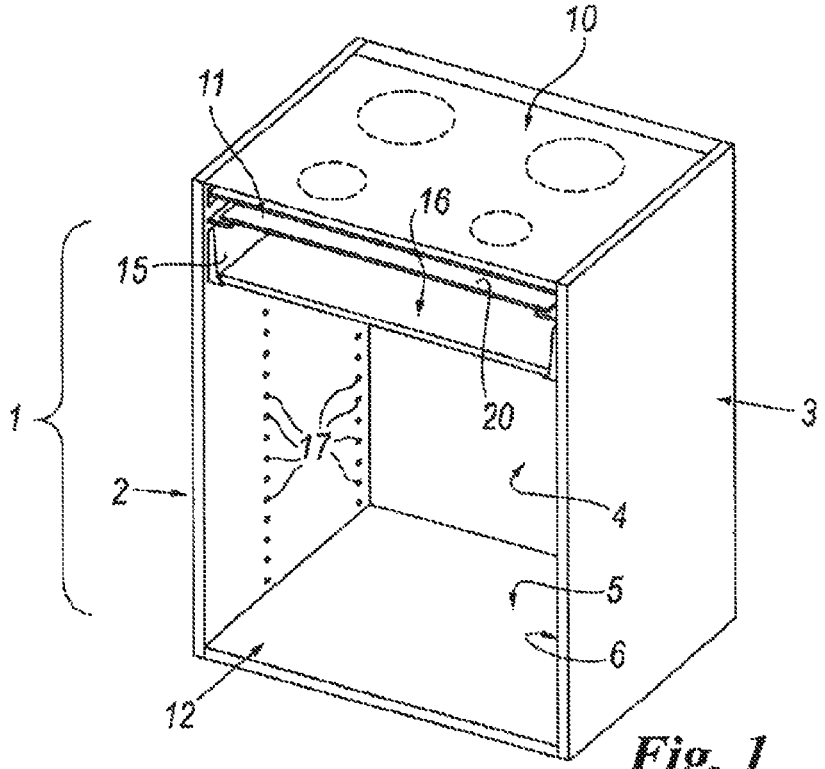
FIG. 1 shows, in partial cut-away, a cabinet adapted to support a cooktop and provided with a partition according to the disclosure.
Figure 2:
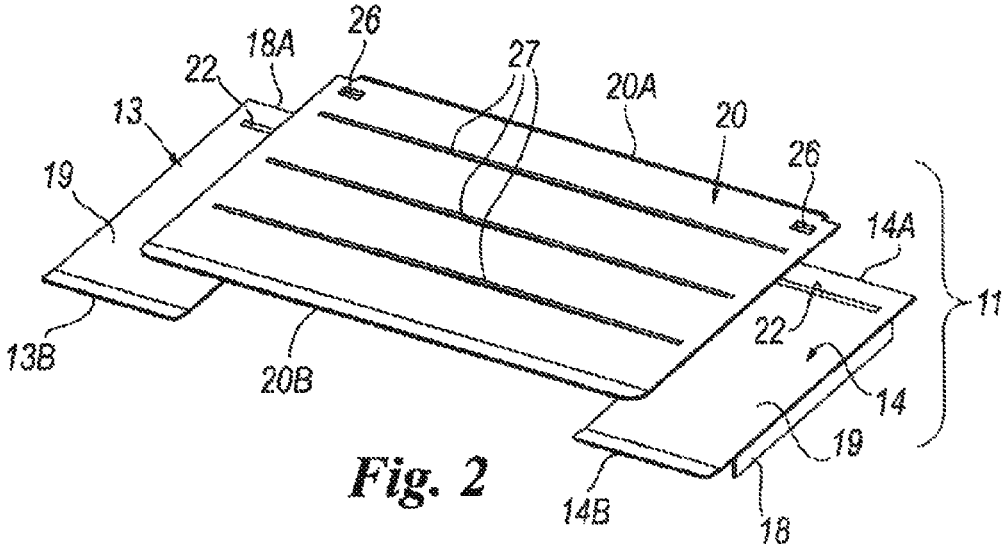
FIG. 2 shows an exploded perspective view of the partition of FIG. 1.
Figure 3:
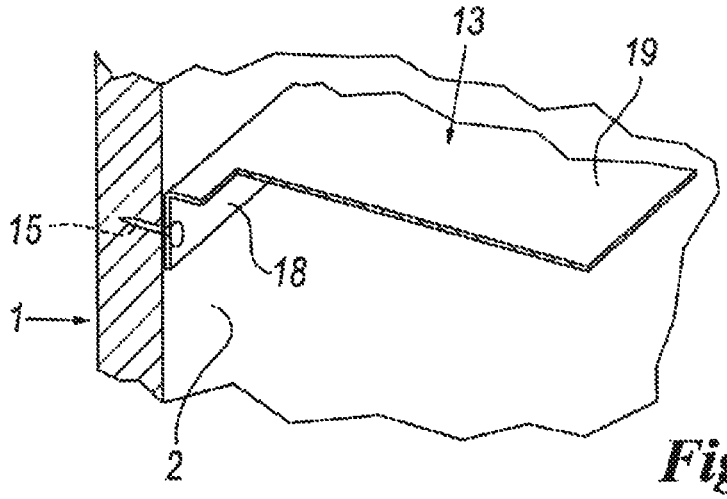
FIG. 3 shows a perspective view of a detail of the partition of FIG. 1.

With reference to the above figures, a cabinet is generally denoted by 1 and comprises opposing side walls 2 and 3, a rear wall 4, a bottom 5, and has a front face 6, open. Above the cabinet 1, a cooktop 10 is placed (shown only schematically).

According to the disclosure, below said top 10 a partition 11 is adapted to separate said top from the interior compartment 12 of the cabinet 1, said partition having adjustable dimensions.

More particularly, the partition 11 comprises first side portions 13, 14 adapted to be fixed, by way of screws 15, to the opposite walls 2 and 3 of the cabinet 1. Preferably, said walls have holes 17 arranged at different heights required to hold the partition 11 in different positions with respect to the cooktop as well as to support shelves or components 15 of a drawer 16 located under the partition 1.

The side portions 13, 14 each presents a substantially L-shape structure with an edge part 18 adapted to be fixed to the corresponding wall 2 and 3 of cabinet 1. Said wall forms a substantially right angle with a part 19 protruding from the abovementioned wall 2, 3 of the compartment 12*e* positioned substantially on a plane orthogonal to the walls 2 and 3.

On the parts 19 of the portions 13, 14 a central portion 20 of the partition 11 is adapted to be arranged (preferably with stiffening ribs 27); the portion 20 overlaps the portions 13, 14 in a differentiated manner according to the distance existing between the lateral walls 3 and 4 of the cabinet 1 as the portion 20 has dimensions such as to overlap, however, the portions 13 and 14, whatever the distance between the parts 2 and 3 may be. This allows the partition 11 to adapt to different dimensions of the cabinet 1, where dimensions denote the distance between the walls 3 and 4 of the latter, the distance being differentiated according to the different size of the cooktop associated with the cabinet 1.

Figure 6:
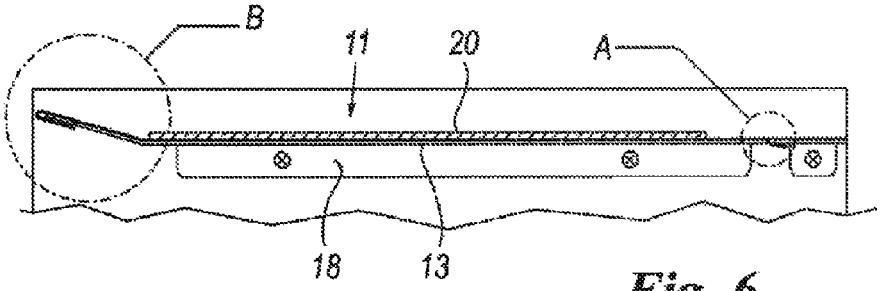
FIG. 6 shows a longitudinal sectional view of the partition of FIG. 1.
Figure 7:
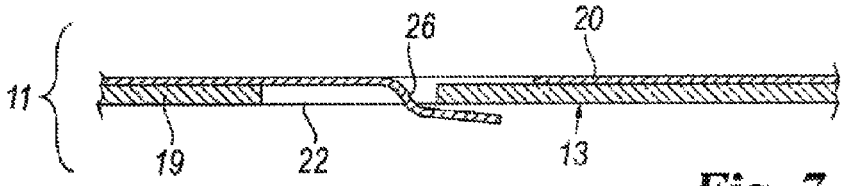
FIGS. 7 and 8 show, respectively, enlarged, the parts denoted by A and B in FIG. 6.

Each lateral portion 13, 14 comprises an elongate slot 22 arranged with its axis substantially orthogonal to the plane of the walls 2 and 3. With each slot a movable tab 26 of the central portion 20 of the partition 11 (see FIGS. 6 and 7) is adapted to cooperate, said tab 26 being folded towards said side portions and penetrating inside the abovementioned slots 22.

Figure 8:
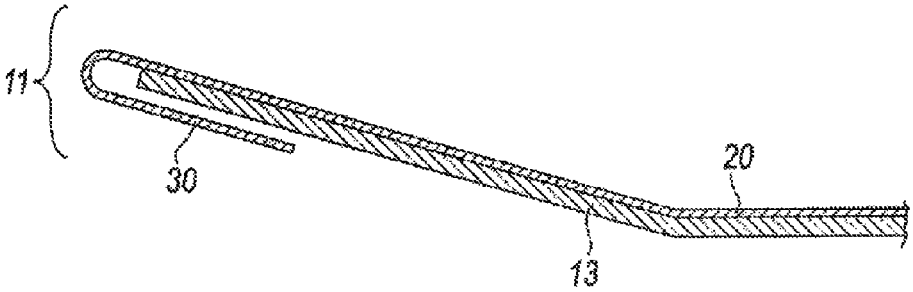

In addition, each portion 13, 14, 20 comprises an end next to the bottom 5 and an end close to the open front face 6 of the cabinet. Respectively, said ends are denoted by 13A, 14A, 20A, 13B, 14B, 20B. The ends 13B, 14B, 20B are inclined with respect to the remaining part of the corresponding portions 13, 14, 20 (i.e. to the parts 19 of the side portions and to said 20 which lie on a plane orthogonal to the walls 2 and 3 when the partition is mounted onto the cabinet 1); the end 20B of the portion 20, in particular, presents a folded portion below the end itself, shown in FIGS. 6 and 8 and is denoted by 30, adapted to overlap the ends 13B, 14B of the adjacent side portions 13, 14 so as to receive said ends and contribute to the bond of the portion 20 to the portions 13 and 14 also contribute to the cooperation between the tabs 26 and the slots 22.

Thanks to said ends overlapping and to the cooperation between tabs and slots, the portion 20 is firmly coupled to the portions 13 and 14 when the partition 1 is assembled. Being the portions 13 and 14 fixed to the side walls 2 and 3 of cabinet 1, the portion 20 results to be firmly fixed to the latter.

Figure 4:
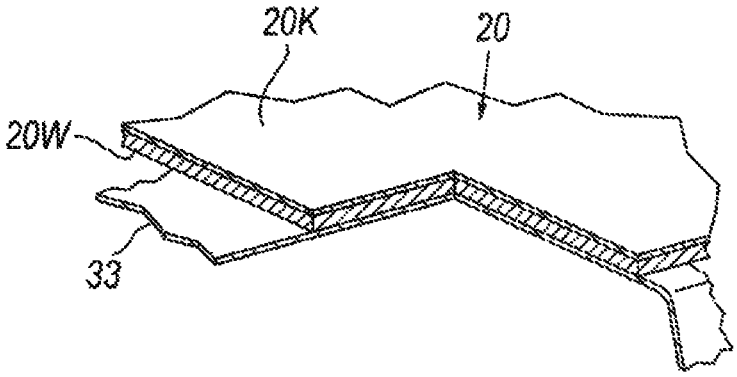
FIG. 4 shows a partial sectional view of the partition of FIG. 1.
Figure 5:
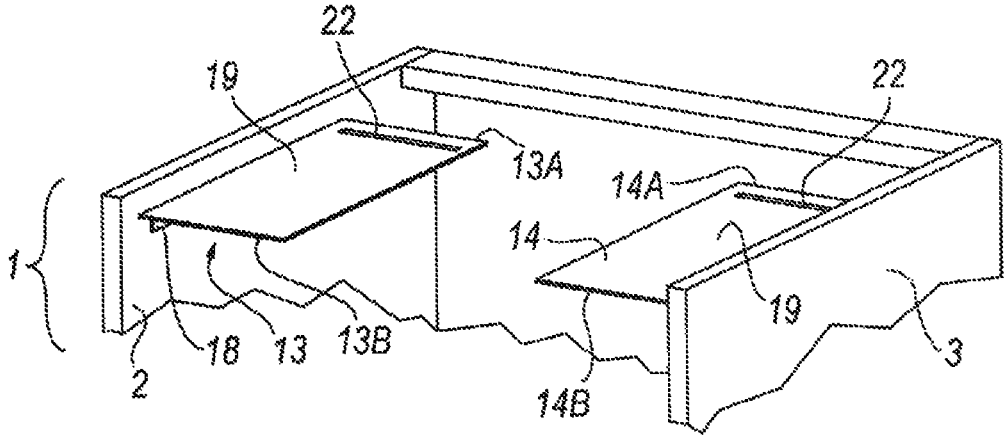
FIG. 5 shows a partial perspective view of the partition of FIG. 1 during assembly.

In this way, a partition 11 between the cooktop 10 and the internal compartment 12 of the abovementioned cabinet is created, the partition preventing the heat from being transferred from the top to said compartment and allowing the arrangement in the latter of a drawer 16 (arranged below the partition) and/or shelves designed to hold objects inside said compartment. In order to avoid the transfer of heat in the compartment 12, the portions 13, 14, 20 of the partition 11 advantageously and preferably present a layered structure comprising a layer of metal material 20K, preferably aluminum, arranged above the portions 13, 14, 20 or at least above the portion with major surface 20. Below said metal layer 20K there is a layer of plastic material 20W, preferably polymeric, such as a polyester sheet. Said layers are shown in FIG. 4 with reference to the portion 20. In said figure is also shown a separator of the drawer 16, separator denoted by the reference 33.

Thanks to the disclosure it is possible to obtain a partition adapted to allow the use of an internal compartment of a cabinet on the upper part of which a cooktop that closes the compartment itself is placed. The above, independently of the size of the compartment i.e. of the distance between the side walls 2 and 3 of cabinet 1.

This is obtained thanks to the use of a partition having separate parts between each other, but firmly coupled when in use, and adapted to be arranged relatively to one another so as to completely close the compartment below the cooktop. An embodiment of the disclosure has been described wherein the partition 11 comprises three portions separated from each other. Obviously, there are other possible alternatives such as those that include a partition having only two portions coupled to each other, or two portions telescopically coupled to each other and fixed to the side walls 2, 3 in the cabinet 1. Also these embodiments are to be considered as comprised within the scope of the following claims.

What is claimed is:

1. A cooktop partition, comprising:

a partition element, the partition element being configured to separate a cooktop, placed on a cabinet, from an inner compartment of said cabinet, said compartment being delimited by side walls by a bottom and by a rear wall, the compartment being independently open and having the cooktop on top of the cabinet, said compartment being adapted to contain objects placed in a drawer or shelves fixed to the side walls thereof, said partition element comprises at least two portions, movable relative to each other in a direction orthogonal to the side walls of the cabinet and being fixed to said side walls, said at least two portions being relatively coupled in a position according to a distance between said side walls and completely dividing the cooktop from the underlying compartment of the cabinet, wherein the partition element comprises three separate portions, including two side portions being fixed to the side walls of the cabinet, and a third portion being arranged on and coupled to said two side portions in a position such as to connect the two side portions and to completely divide the cooktop from the underlying compartment and wherein each of the three separate portions has an edge facing an opening of the compartment of the cabinet, said edge being inclined with respect to a remaining part of the corresponding portion placed on a plane orthogonal to the side walls of said cabinet, the inclined edge of the third portion adapted to overlap the side portions and having a folded part adapted to receive the corresponding inclined edges of said side portions.

2. The partition of claim 1, wherein each of the side portions is substantially L-shaped and has an edge fixed to a corresponding side wall of the cabinet and a part positioned perpendicular to said edge and projecting from the corresponding side wall.

3. The partition of claim 1, wherein the side portions are coupled to the third portion with elongated slots cooperating with tabs.

4. The partition of claim 3, wherein:

the elongated slots are provided in the side portions, with the elongated slot of each side portion being located in a respective part positioned perpendicular to an edge of the side portion; and the tabs are formed integrally with the third portion and project downward from the third portion.

5. The partition of claim 4, wherein the tabs also project rearward from the third portion.

6. The partition of claim 1, wherein two portions of the partition element are telescopically coupled together.

7. The partition element of claim 1, wherein each of the three separate portions has a layered structure configured to prevent a transfer of heat from the cooktop to the underlying compartment, the layered structure including a layer of metal material and a layer of plastic material.

8. A cooking appliance comprising:

a cabinet including an inner compartment delimited by side walls, a bottom wall and a rear wall, the inner compartment being configured to contain objects placed in a drawer or on shelves fixed to the side walls;

a cooktop supported upon the cabinet; and a cooktop partition located proximate to the cooktop and separating the cooktop from the inner compartment of the cabinet, the cooktop partition including:

at least two portions, movable relative to each other in a direction orthogonal to the side walls of the cabinet and being fixed to said side walls, said at least two portions being relatively coupled in a position according to a distance between said side walls and completely dividing the cooktop from the underlying compartment of the cabinet, wherein the cooktop partition includes three separate portions, including two side portions fixed to the side walls of the cabinet and a third portion coupled to and arranged on the two side portions so as to connect the two side portions and to completely divide the cooktop from the underlying compartment, and wherein each of the three separate portions has a layered structure configured to prevent a transfer of heat from the cooktop to the underlying compartment.

9. The cooking appliance of claim 8, wherein the third portion is coupled to the two side portions through interconnecting tabs and elongated slots.

10. The cooking appliance of claim 9, wherein:

each side portion includes a horizontal planar portion projecting from a respective side wall of the cabinet;

the elongated slots are provided in the side portions, with the elongated slot of each side portion being located in a respective horizontal planar portion; and the tabs are formed integral with the third portion and project downward from the third portion.

11. The cooking appliance of claim 8, wherein the layered structure includes a layer of metal material and a layer of plastic material.

12. The cooking appliance of claim 8, wherein each of the three separate portions has an edge facing an opening of the compartment of the cabinet, the edge being inclined with respect to a remaining part of the corresponding portion placed on a plane orthogonal to the side walls of said cabinet, the inclined edge of the third portion overlapping the side portions and having a folded part adapted to receive the corresponding inclined edges of said side portions.

13. The cooking appliance of claim 8, wherein each of the side portions is substantially L-shaped and has an edge fixed to a corresponding side wall of the cabinet and a part positioned perpendicular to said edge and projecting from the corresponding wall.

14. The cooking appliance of claim 8, wherein the two portions of the partition element are telescopically coupled together.

15. A cooking appliance comprising:

a cabinet including an inner compartment delimited by side walls, a bottom wall and a rear wall, the inner compartment being configured to contain objects placed in a drawer or on shelves fixed to the side walls;

a cooktop supported upon the cabinet; and a cooktop partition located proximate to the cooktop and separating the cooktop from the inner compartment of the cabinet, the cooktop partition including:

at least two portions, movable relative to each other in a direction orthogonal to the side walls of the cabinet and being fixed to said side walls, said at least two portions being relatively coupled in a position according to a distance between said side walls and completely dividing the cooktop from the underlying compartment of the cabinet, wherein the cooktop partition includes three separate portions, including two side portions fixed to the side walls of the cabinet and a third portion coupled to and arranged on the two side portions so as to connect the two side portions and to completely divide the cooktop from the underlying compartment, wherein:

the third portion is coupled to the two side portions through interconnecting tabs and elongated slots;

each side portion includes a horizontal planar portion projecting from a respective side wall of the cabinet;

the elongated slots are provided in the side portions, with the elongated slot of each side portion being located in a respective horizontal planar portion;

the tabs are formed integral with the third portion and project downward from the third portion; and each tab also projects rearward from the third portion.

* * * * *